US011453467B2

(12) United States Patent
Inoue

(10) Patent No.: US 11,453,467 B2
(45) Date of Patent: Sep. 27, 2022

(54) CONTROL SYSTEM FOR POSTURE CONTROL TABS OF MARINE VESSEL, MARINE VESSEL, AND METHOD FOR CONTROLLING POSTURE CONTROL TABS, CAPABLE OF AVOIDING CONTACT OF POSTURE CONTROL TABS WITH FOREIGN OBJECT

(71) Applicant: YAMAHA HATSUDOKI KABUSHIKI KAISHA, Iwata (JP)

(72) Inventor: Hiroshi Inoue, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 90 days.

(21) Appl. No.: 17/061,652

(22) Filed: Oct. 2, 2020

(65) Prior Publication Data

US 2021/0129949 A1 May 6, 2021

(30) Foreign Application Priority Data

Nov. 5, 2019 (JP) ..... JP2019-200520

(51) Int. Cl.
*B63B 39/06* (2006.01)
*B63B 1/22* (2006.01)

(52) U.S. Cl.
CPC ..... *B63B 39/061* (2013.01); *B63B 1/22* (2013.01)

(58) Field of Classification Search
CPC ..... B63H 25/44; B63H 25/00; B63B 39/061; B63B 1/22; B63B 43/00; G05D 1/0875
See application file for complete search history.

(56) References Cited

U.S. PATENT DOCUMENTS 5,113,780 A * 5/1992 Bennett ..... B63B 39/061 114/286
7,140,318 B1 * 11/2006 Gasper ..... B63H 25/44 114/285
7,942,711 B1 * 5/2011 Swan ..... B63B 39/061 440/61 G
8,261,682 B1 9/2012 DeVito
2010/0131304 A1 * 5/2010 Collopy ..... G06Q 30/0224 705/4

(Continued)

FOREIGN PATENT DOCUMENTS

CA 2 568 275 A1 6/2007
JP 2005-082030 A 3/2005

(Continued)

OTHER PUBLICATIONS

Official Communication issued in corresponding European Patent Application No. 20201210.0, dated Apr. 6, 2021.

(Continued)

*Primary Examiner* — Anthony D Wiest
(74) *Attorney, Agent, or Firm* — Keating and Bennett, LLP

(57) ABSTRACT

A control system for posture control tabs of a marine vessel prevents posture control tabs from coming into contact with a foreign object. The posture control tabs are mounted on a stern to control a posture of a hull. Actuators actuate the respective posture control tabs. When it is judged that that the hull is being loaded onto a trailer or it is detected that the hull has entered a speed restriction zone, a controller controls the actuators to position the posture control tabs at retracted positions.

7 Claims, 5 Drawing Sheets

(56) References Cited

U.S. PATENT DOCUMENTS

| | | | | |
|---|---|---|---|---|
| 2016/0180721 | A1* | 6/2016 | Otulic | B63H 25/02 701/2 |
| 2019/0291832 | A1 | 9/2019 | Hashizume et al. | |

FOREIGN PATENT DOCUMENTS

| | | | |
|---|---|---|---|
| JP | 2009-262588 | A | 11/2009 |
| JP | 2013-006578 | A | 1/2013 |
| JP | 2013-106082 | A | 5/2013 |

OTHER PUBLICATIONS

Zipwake, "Operators Manual Dynamic Trim Control System", Retrieved from the Internet http://www.zipwake.com, retrieved on Jun. 3, 2020, 147 pages.

* cited by examiner

CONTROL SYSTEM FOR POSTURE CONTROL TABS OF MARINE VESSEL, MARINE VESSEL, AND METHOD FOR CONTROLLING POSTURE CONTROL TABS, CAPABLE OF AVOIDING CONTACT OF POSTURE CONTROL TABS WITH FOREIGN OBJECT

CROSS REFERENCE TO RELATED APPLICATIONS

This application claims the benefit of priority to Japanese Patent Application No. 2019-200520 filed on Nov. 5, 2019. The entire contents of this application are hereby incorporated herein by reference.

BACKGROUND OF THE INVENTION

1. Field of the Invention

The present invention relates to control systems for posture control tabs, marine vessels, and methods for controlling the posture control tabs of the marine vessel, which are each able to avoid contact of the posture control tabs with a foreign object.

2. Description of the Related Art

Conventionally, marine vessels equipped with posture control tabs like trim tabs for changing the posture of a hull as disclosed in U.S. Pat. No. 8,261,682 and Zipwake "Dynamic Trim-Control System" (URL: http://www.zipwake.com; hereafter referred to merely as Zipwake) are known. Posture control tabs are mounted on the stern of a hull such that they are able to, for example, swing with respect to or project from a retracted position at which they are not in use. When a marine vessel is transported on land, the marine vessel is typically loaded onto a trailer. To load a marine vessel on a trailer at the shore, the hull of the marine vessel is usually tilted so the bow can rise.

However, there may be a case in which a marine vessel is loaded onto a trailer with the posture control tabs in a down position. For example, there may be a case in which the posture control tabs have been manually lowered before the marine vessel is loaded onto the trailer. Also, there may be a case in which the posture control tabs have been lowered during sailing in a posture-control mode in which the posture control tabs are automatically controlled. If a marine vessel is loaded onto a trailer with the posture control tabs down, and the bow rises, the posture control tabs mounted on the stern may come close to a foreign object such as a rail of the trailer, the ground, or the sea bottom. There is room for improvement from the viewpoint of avoiding contact of the posture control tabs with the foreign object.

SUMMARY OF THE INVENTION

Preferred embodiments of the present invention provide control systems to control posture control tabs of a marine vessel, marine vessels, and methods for controlling the posture control tabs of the marine vessel, which are each able to avoid contact of the posture control tabs with a foreign object.

According to a preferred embodiment of the present invention, a control system includes posture control tabs mounted on a stern to control a posture of a hull of a marine vessel, and actuators to actuate the posture control tabs. The control system further includes a central processing unit configured or programmed to define and function as a judgment unit to judge whether or not the hull is being loaded onto a trailer, and a processor to, upon the judgment unit judging that the hull is being loaded onto the trailer, control the actuators to position the posture control tabs at retracted positions.

According to another preferred embodiment of the present invention, a control system includes posture control tabs mounted on a stern to control a posture of a hull of a marine vessel and actuators to actuate the posture control tabs. The control system further includes a central processing unit configured or programmed to define and function as a detection unit to detect whether or not the hull has entered a speed restriction zone, and a processor to, upon the detection unit detecting that the hull has entered the speed restriction zone, control the actuators to position the posture control tabs at retracted positions.

According to another preferred embodiment of the present invention, a marine vessel includes a hull, and one of the above-described control systems.

According to another preferred embodiment of the present invention, a method controls posture control tabs of a marine vessel, wherein the marine vessel includes posture control tabs mounted on a stern to control a posture of a hull, and actuators to actuate the posture control tabs. The method includes judging with a judgment unit whether or not the hull is being loaded onto a trailer, and upon the judgment unit judging that the hull is being loaded onto the trailer, controlling with a processor the actuators to position the posture control tabs at retracted positions.

According to another preferred embodiment of the present invention, a method controls posture control tabs of a marine vessel, wherein the marine vessel includes posture control tabs mounted on a stern to control a posture of a hull, and actuators to actuate the posture control tabs. The method includes detecting with a detection unit whether or not the hull has entered a speed restriction zone, and upon the detection unit detecting that the hull has entered the speed restriction zone, controlling with a processor the actuators to position the posture control tabs at retracted positions.

According to preferred embodiments of the present invention, when it is judged that the hull is being loaded onto the trailer or it is detected that the hull has entered a speed restriction zone, the actuators are controlled so that the posture control tabs that control the posture of the hull are positioned at the retracted position. As a result, the posture control tabs do not come too close to a foreign object such as a rail of the trailer when being loaded onto the trailer, and thus contact of the posture control tabs with a foreign object is avoided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments will be described with reference to the drawings.

Figure 1:
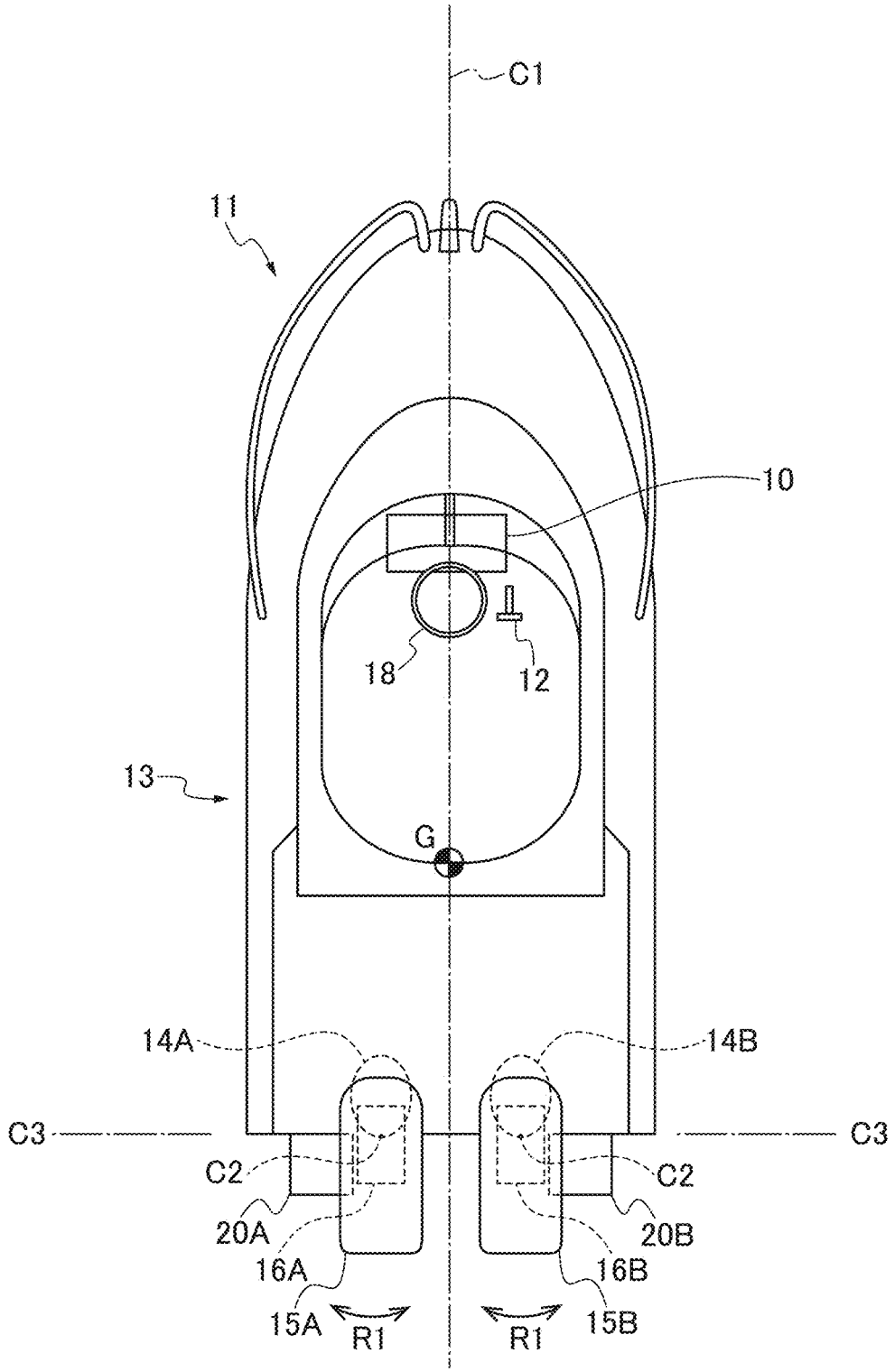
FIG. 1 is a top view of a marine vessel to which a posture control system for posture control tabs according to a preferred embodiment of the present invention is provided.

FIG. 1 is a top view of a marine vessel to which a control system for posture control tabs according to a referred embodiment of the present invention is provided. The marine vessel 11 includes a hull 13, a plurality of outboard motors (for example, two outboard motors 15A, 15B), which define and function as marine propulsion devices mounted on the hull 13, and a plurality of trim tab units (for example, a pair of trim tab units 20A, 20B). A central unit 10, a steering wheel 18, and a throttle lever 12 are provided in the vicinity of a cockpit in the hull 13.

In the following description, a fore-and-aft direction, a crosswise direction, and a vertical direction refer to a fore-and-aft direction, a crosswise direction, and a vertical direction, respectively, of the hull 13. For example, as shown in FIG. 1, a centerline C1 extending in the fore-and-aft direction of the hull 13 passes through the center of gravity G of the marine vessel 11. The fore-and-aft direction is the direction along the centerline C1. Fore or front refers to the direction toward the upper side of the view along the centerline C1. Aft or rear refers to the direction toward the lower side of the view along the centerline C1. The crosswise direction is defined based on a case in which the hull 13 is viewed from the rear. The vertical direction is vertical to the fore-and-aft direction and the crosswise direction.

The two outboard motors 15A and 15B are mounted on a stern of the hull 13 side by side. To distinguish the two outboard motors 15A and 15B, the one located on the port side is referred to as the "outboard motor 15A", and the one located on the starboard side is referred to as the "outboard motor 15B". The outboard motors 15A and 15B are mounted on the hull 13 via mounting units 14A an 14B, respectively. The outboard motors 15A and 15B include engines 16A and 16B, respectively, which are preferably internal combustion engines. The outboard motors 15A and 15B generate propulsive forces to move the hull 13 by using propellers (not illustrated) that are turned by driving forces of the corresponding engines 16A and 16B.

Figure 3:
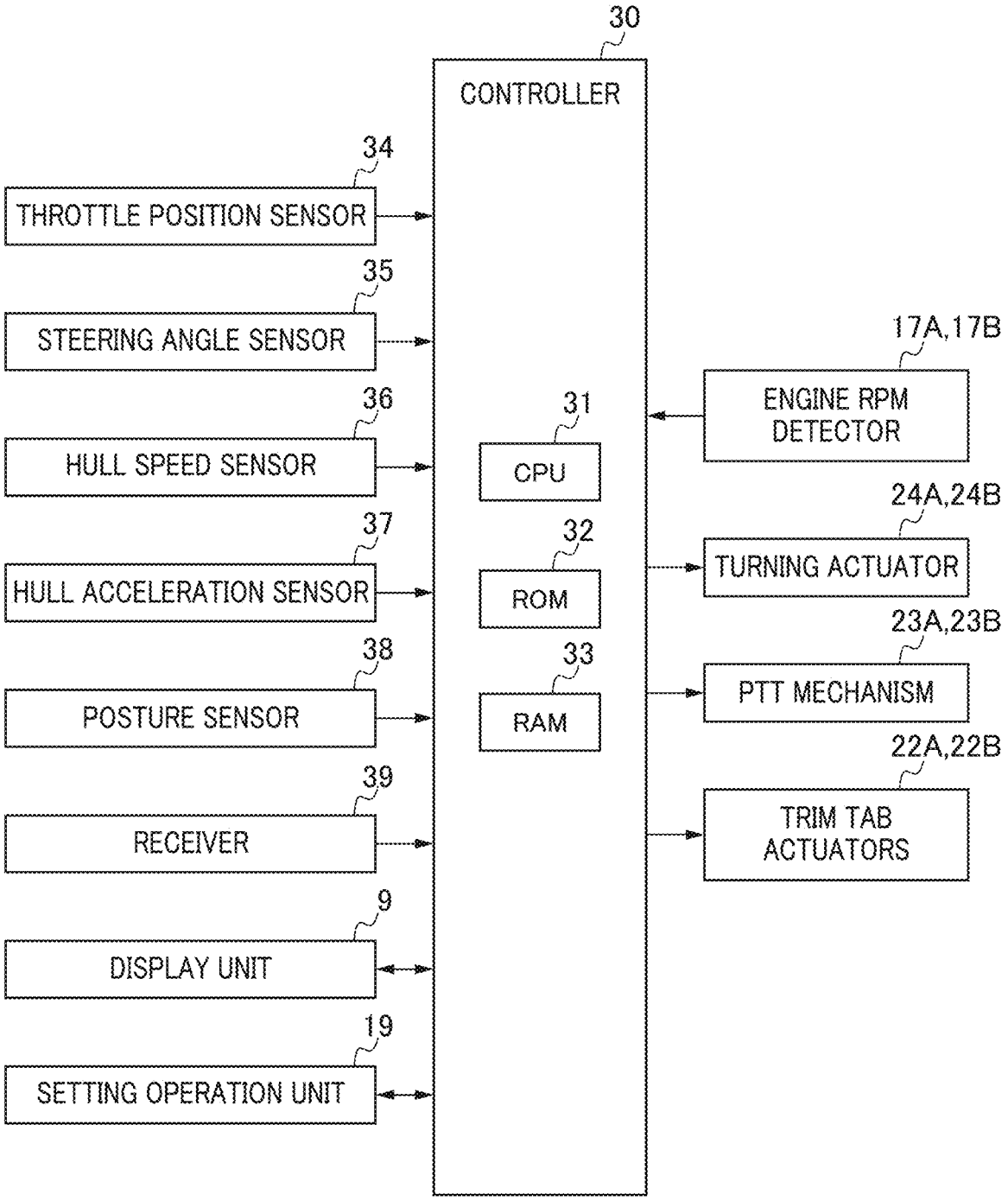
FIG. 3 is a block diagram of a maneuvering system.

The mounting units 14A and 14B each include a swivel bracket, a clamp bracket, a steering shaft, and a tilt shaft (none of which are illustrated). The mounting units 14A and 14B further include power trim and tilt mechanisms (PTT mechanisms) 23A and 23B, respectively (FIG. 3). The PTT mechanisms 23A and 23B turn the corresponding outboard motors 15A and 15B about the tilt shaft. This makes it possible to change an inclination angle of the outboard motors 15A and 15B with respect to the hull 13, and thus a trim adjustment to be made, and the outboard motors 15A and 15B are tilted up and down. Moreover, each of the outboard motors 15A and 15B is able to turn about a turning center C2 (about the steering shaft) with respect to the swivel bracket. Operating the steering wheel 18 causes each of the outboard motors 15A and 15B to turn about the turning center C2 in the crosswise direction (direction R1). Thus, the marine vessel 11 is steered.

The pair of trim tab units 20A and 20B are mounted on the stern on the port side and the starboard side such that they are able to swing about a swing axis C3. To distinguish the two trim tab units 20A and 20B from each other, the one located on the port side is referred to as the "trim tab unit 20A", and the one located on the starboard side is referred to as the "trim tab unit 20B".

Figure 2:
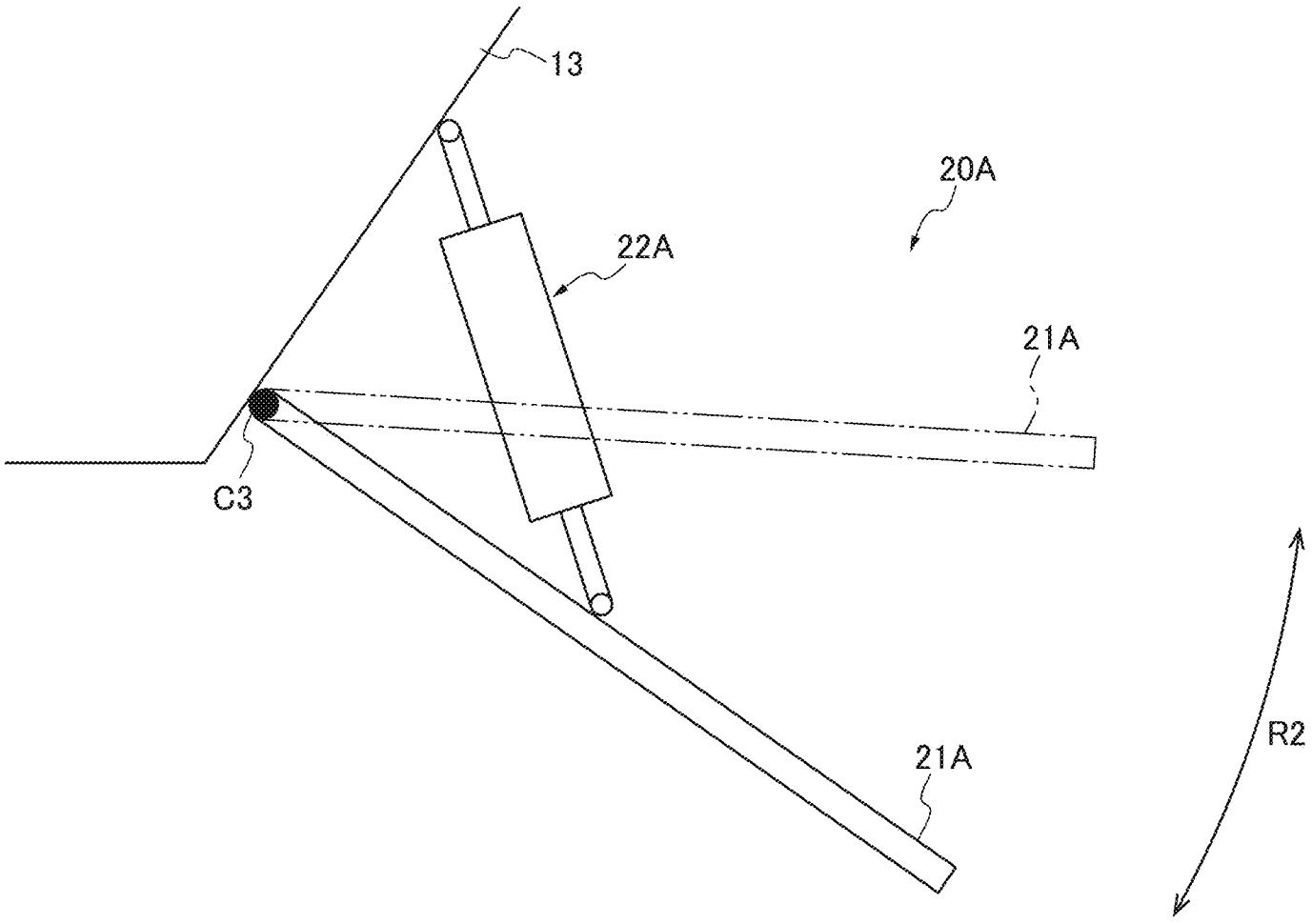
FIG. 2 is a side view of a trim tab unit attached to a hull.

FIG. 2 is a side view of the trim tab unit 20A attached to the hull 13. The trim tab units 20A and 20B have the same construction, and thus a construction of only the trim tab unit 20A will now be described as a representative example. The trim tab unit 20A includes a trim tab actuator 22A and a tab 21A. The tab 21A is attached to the rear of the hull 13 such that it is able to swing about the swing axis C3. For example, the proximal end of the tab 21A is attached to the rear of the hull 13, and the free end of the tab 21A swings up and down (in a swinging direction R2) about the swing axis C3. The tab 21A is an example of a posture control tab that controls the posture of the hull 13.

The trim tab actuator 22A is disposed between the tab 21A and the hull 13 such that it connects the tab 21A and the hull 13 together. The trim tab actuator 22A actuates the tab 21A to swing it with respect to the hull 13. It should be noted that the tab 21A indicated by a chain double-dashed line in FIG. 2 is at a position where its free end is at the highest level (a position at which the amount of lowering of the tab 21A is 0%), and this position corresponds to a retracted position. The tab 21A indicated by a solid line in FIG. 2 is at a position where its free end is at a lower level than a keel at the bottom of the marine vessel 11. It should be noted that a range in which the tab 21A is able to swing is not limited to the one illustrated in FIG. 2. The swinging direction R2 is defined with reference to the swing axis C3. The swing axis C3 is perpendicular or substantially perpendicular to the centerline C1 and parallel or substantially parallel to, for example, the crosswise direction. It should be noted that the swing axis C3 may extend diagonally so as to cross the turning center C2.

FIG. 3 is a block diagram of a maneuvering system. The maneuvering system includes a control system for the posture control tabs according to the present preferred embodiment. The marine vessel 11 includes a controller 30, a throttle position sensor 34, a steering angle sensor 35, a hull speed sensor 36, a hull acceleration sensor 37, a posture sensor 38, a receiver 39, a display unit 9, and a setting operation unit 19. The marine vessel 11 also includes engine rpm detectors 17A and 17B, turning actuators 24A and 24B, the PTT mechanisms 23A and 23B, the trim tab actuators 22A and 22B (see FIG. 2 as well).

The controller 30, the throttle position sensor 34, the steering angle sensor 35, the hull speed sensor 36, the hull acceleration sensor 37, the posture sensor 38, the receiver 39, the display unit 9, and the setting operation unit 19 are included in the central unit 10 or disposed in the vicinity of the central unit 10. The turning actuators 24A and 24B and the PTT mechanisms 23A and 23B are provided for the respective outboard motors 15A and 15B. The engine rpm detectors 17A and 17B are provided in the respective outboard motors 15A and 15B. The trim tab actuators 22A and 22B are included in the trim tab units 20A and 20B, respectively.

The controller 30 includes a CPU 31, a ROM 32, a RAM 33, and a timer which is not illustrated. The ROM 32 stores control programs. The CPU 31 loads the control programs stored in the ROM 32 into the RAM 33 to implement various types of control processes. The RAM 33 provides a work area for the CPU 31 to execute the control programs.

Results of detection by the sensors 34 to 39 and the engine rpm detectors 17A and 17B are supplied to the controller 30. The throttle position sensor 34 detects the opening angle of a throttle valve, which is not illustrated. The steering angle sensor 35 detects the turning angle of the steering wheel 18. The hull speed sensor 36 and the hull acceleration sensor 37 detect the speed and acceleration, respectively, of the marine vessel 11 (the hull 13) while it is traveling.

The posture sensor 38 includes, for example, a gyro sensor, a magnetic direction sensor, and so forth. Based on a signal output from the posture sensor 38, the controller 30 calculates a roll angle, a pitch angle, and a yaw angle of the hull 13. It should be noted that the controller 30 may calculate the roll angle and the pitch angle based on a signal output from the hull acceleration sensor 37. The receiver 39 includes a GNSS (Global Navigation Satellite Systems) receiver such as a GPS and includes a function of receiving GPS signals and various types of signals as positional information. From a speed restriction zone or land in the vicinity of the speed restriction zone, an identification signal providing notification that the area is a speed restriction zone is transmitted. The speed restriction zone refers to an area in a harbor or the like in which is required to limit the speed of a marine vessel to a predetermined speed or lower. The receiver 39 also includes a function of receiving the identification signal. It should be noted that the acceleration of the hull 13 may also be obtained from a GPS signal received by the receiver 39.

The engine rpm detectors 17A and 17B detect the number of revolutions of the respective engines 16A and 16B per unit time (hereafter referred to as "the engine rpm N"). The display unit 9 displays various types of information. The setting operation unit 19 includes an operator that a vessel operator uses to perform operations relating to maneuvering, a PTT operating switch, a setting operator that a vessel operator uses to make various settings, and an input operator that a vessel operator uses to input various types of instructions (none of which are illustrated).

The turning actuators 24A and 24B turn the respective outboard motors 15A and 15B about the turning center C2 with respect to the hull 13. Turning the outboard motors 15A and 15B about the turning center C2 changes the direction in which a propulsion force acts on the centerline C1 of the hull 13. The PTT mechanisms 23A and 23B tilt the respective outboard motors 15A and 15B with respect to the clamp bracket by turning the respective outboard motors 15A and 15B about the tilt shaft. The PTT mechanisms 23A and 23B are operated in response to, for example, operation of the PTT operating switch. As a result, the inclination angle of the outboard motors 15A and 15B with respect to the hull 13 is changed.

The trim tab actuators 22A and 22B are controlled by the controller 30, more specifically, by a processor in the CPU 31 within the controller 30. For example, the trim tab actuators 22A and 22B operate in response to the controller 30 outputting control signals to them. In response to the operation of one of the trim tab actuators 22A and 22B, a corresponding one of the tabs 21A and 21B swings. It should be noted that actuators used for the PTT mechanisms 23A and 23B and the trim tab actuators 22A and 22B may be either hydraulic or electric.

It should be noted that the controller 30 may obtain results of detection by the engine rpm detectors 17A and 17B via a remote control ECU, which is not illustrated. The controller 30 may also use outboard motor ECUs (not illustrated) provided in the respective outboard motors 15A and 15B, to control the respective engines 16A and 16B.

Figure 4:
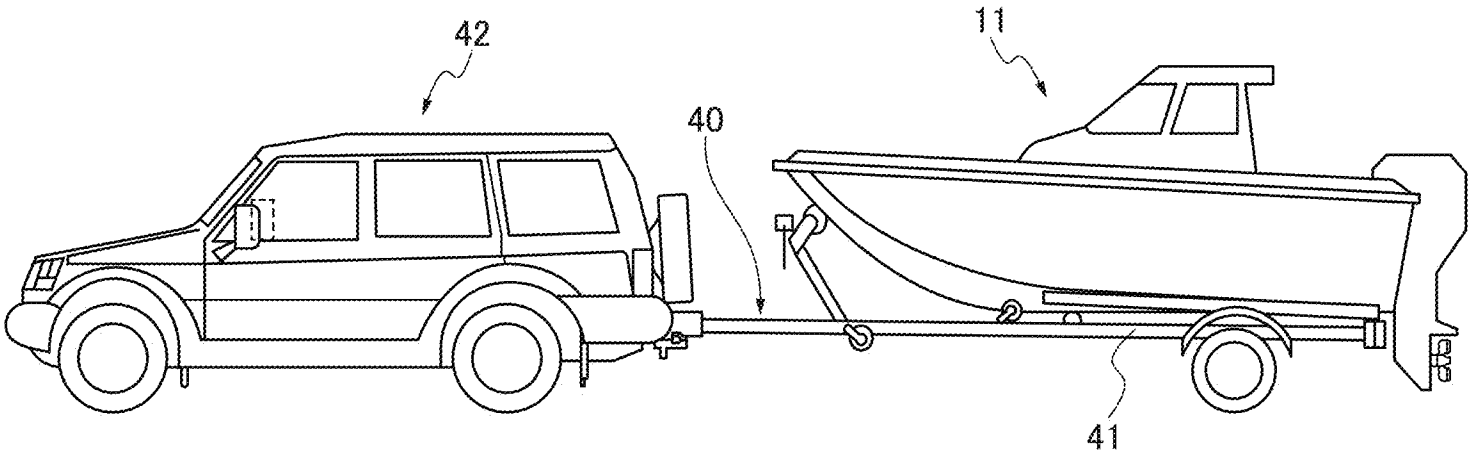
FIG. 4 is a side view of a marine vessel being transported on land.

FIG. 4 is a side view showing how the marine vessel 11 is transported on land. As shown in FIG. 4, the marine vessel 11 is sometimes transported by a motor vehicle 42 and a trailer 40. While the marine vessel 11 is being loaded onto the trailer 40 at the shore, the marine vessel 11 is usually tilted to raise the bow. If loading of the marine vessel 11 onto the trailer 40 is started with the tabs 21A and 21B in a down position, the marine vessel 11 is tilted causing the tabs 21A and 21B to come close to a foreign object such as the sea bottom, ground, or a rail 41 of the trailer 40. It is preferable to avoid contact of the tabs 21A and 21B with the foreign object. Accordingly, in the present preferred embodiment, as will be described below, the controller 30 raises the tabs 21A and 21B and positions them at the retracted positions while, for example, the hull 13 is being loaded onto the trailer 40.

It should be noted that the tab 21A indicated by the chain double-dashed line in FIG. 2 is located parallel or substantially parallel to the bottom of the hull 13 (keel) in the side view. In the present preferred embodiment, the tabs 21A and 21B have only to be controlled so as to reliably prevent the trailer 40 or the like from interfering with the tabs 21A and 21B. Thus, the retracted positions to which the tabs 21A and 21B are raised while, for example, the hull 13 is being loaded onto the trailer 40, are not limited to the positions at which the amount of lowering of the tabs 21A and 21B is 0%, but may be positions of the tabs 21A and 21B that are, for example, parallel or substantially parallel to or above the vessel's bottom. Alternatively, the retracted positions may be positions at which the amount of lowering of the tabs 21A and 21B is equal to or greater than a predetermined amount (for example, about 10%). It should be noted that when the marine vessel 11 is moved rearward, the tabs 21A and 21B may be fully raised (positioned at the retracted positions) irrespective of a currently-set control mode.

Figure 5:
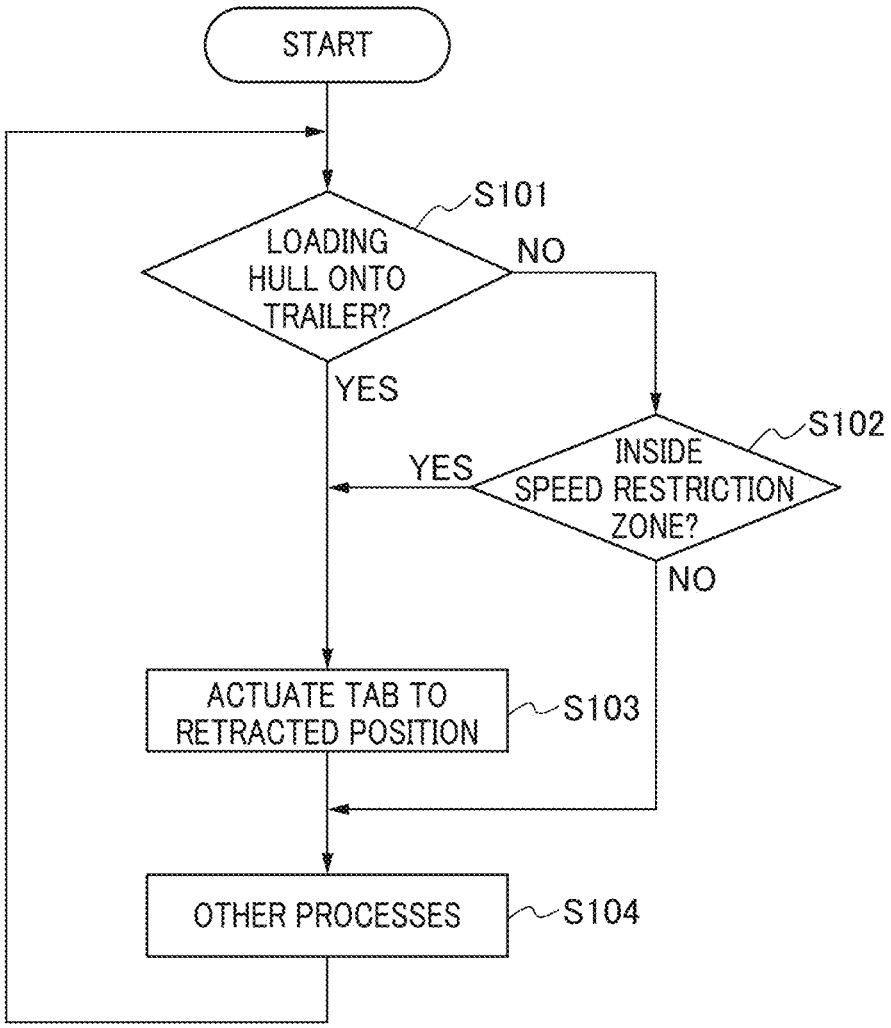
FIG. 5 is a flowchart of a trim tab retracting process.

FIG. 5 is a flowchart of a trim tab retracting process. This process is implemented by the CPU 31 loading a control program stored in the ROM 32 into the RAM 33 and executing the same. This process starts when, for example, the maneuvering system is activated. In step S101, the CPU 31, which defines and functions as a judgment unit, judges whether or not the hull 13 is being loaded onto the trailer 40. Here, the method to judge whether or not the hull 13 is being loaded onto the trailer 40 is not limited, but mainly, methods described hereafter (the first to eighth methods) may be used.

First, according to the first method, based on a speed V of the hull 13 and a pitch angle P of the hull 13, the CPU 31 judges whether or not the hull 13 is being loaded onto the trailer 40. The speed V is obtained from a signal output from the speed sensor 36, and the pitch angle P is obtained from a signal output from the posture sensor 38. Specifically, when the conditions that the speed V is less than (<) a predetermined speed, and a predetermined pitch angle is less than (<) the pitch angle P are satisfied, the CPU 31 judges that the hull 13 is being loaded onto the trailer 40.

According to the second method, based on the speed V of the hull 13 and an engine rpm N, the CPU 31 judges whether or not the hull 13 is being loaded onto the trailer 40. The engine rpm N is obtained from the engine rpm detectors 17A and 17B. It should be noted that an engine targeted in obtaining the engine rpm N may be either one or both of the engines 16A and 16B (the same holds for the methods described below). For example, the CPU 31 may use either a higher one or a lower one of the engine rpm N of the engine 16A and the engine rpm N of the engine 16B.

Specifically, when the conditions that the speed V is less than (<) the predetermined speed, and the predetermined rpm is less than (<) the engine rpm N are satisfied, the CPU 31 judges that the hull 13 is being loaded onto the trailer 40. Alternatively, the CPU 31 may calculate a degree of change ΔN in the engine rpm N from the engine rpm N through integration calculation or the like, and when the conditions that the speed V is less than (<) the predetermined speed, and the predetermined degree of change is less than (<) the degree of change ΔN are satisfied, the CPU 31 may judge that the hull 13 is being loaded onto the trailer 40.

According to the third method, based on a throttle opening angle TH of the engines 16A and 16B and the speed V of the hull 13, the CPU 31 judges whether or not the hull 13 is being loaded onto the trailer 40. The throttle opening TH is obtained from the throttle position sensor 34. It should be noted that an engine targeted in obtaining the throttle opening angle TH may be either one or both of the engines 16A and 16B (the same holds for the methods described below). For example, the CPU 31 may use either a higher one or a lower one of the throttle opening angle TH of the engine 16A and the throttle opening angle TH of the engine 16B or may use an average of both, to obtain the throttle opening angle TH to be used for the judgment. Specifically, when the speed V has not exceeded a predetermined speed for a predetermined period of time since the throttle opening angle TH became greater than a predetermined opening angle (the predetermined angle< the throttle opening angle TH), the CPU 31 judges that the hull 13 is being loaded onto the trailer 40.

According to the fourth method, based on an acceleration A of the hull 13 and the pitch angle P of the hull 13, the CPU 31 judges whether or not the hull 13 is being loaded onto the trailer 40. The acceleration A is obtained from, for example, the hull acceleration sensor 37. Specifically, when the conditions that the acceleration A is less than (<) a predetermined acceleration, and a predetermined pitch angle is less than (<) the pitch angle P are satisfied, the CPU 31 judges that the hull 13 is being loaded onto the trailer 40.

According to the fifth method, based on the acceleration A of the hull 13 and the engine rpm N, the CPU 31 judges whether or not the hull 13 is being loaded onto the trailer 40. Specifically, when the conditions that the acceleration A is less than (<) a predetermined acceleration, and a predetermined engine rpm is less than (<) the engine rpm N are satisfied, the CPU 31 judges that the hull 13 is being loaded onto the trailer 40. It should be noted that as with the second method, the degree of change ΔN in the engine rpm N may be used in place of the engine rpm N.

According to the sixth method, based on the throttle opening angle TH of the engines 16A and 16B and the acceleration A of the hull 13, the CPU 31 judges whether or not the hull 13 is being loaded onto the trailer 40. Specifically, when the acceleration A has never exceeded a predetermined acceleration for a predetermined period of time since the throttle opening angle TH became greater than a predetermined opening angle (the predetermined angle< the throttle opening angle TH), the CPU 31 judges that the hull 13 is being loaded onto the trailer 40.

According to the seventh method, based on the throttle opening angle TH of the engines 16A and 16B and the pitch angle P of the hull 13, the CPU 31 judges whether or not the hull 13 is being loaded onto the trailer 40. Specifically, when a predetermined pitch angle is less than (<) the pitch angle P, the CPU 31 judges that the hull 13 is being loaded onto the trailer 40 even if a state in which a predetermined opening angle is less than (<) the throttle opening angle TH has continued for a predetermined period of time.

According to the eighth method, based on the engine rpm N and the pitch angle P of the hull 13, the CPU 31 judges whether or not the hull 13 is being loaded onto the trailer 40. Specifically, when a predetermined pitch angle is less than (<) the pitch angle P, the CPU 31 judges that the hull 13 is being loaded onto the trailer 40 even if a state in which a predetermined rpm is less than (<) the engine rpm N has continued for a predetermined period of time.

It should be noted that one of the methods described above may be used, or the methods described above may be used in combination as appropriate. Besides, the marine vessel 11 may be equipped with a camera, and based on an image (an image of the hull 13, the surface of the sea, or the like) shot by this camera, the CPU 31 may judge whether or not the hull 13 is being loaded onto the trailer 40. It should be noted that the marine vessel 11 may be equipped with an automatic trailering function to automatically load the hull 13 onto the trailer 40 and transport it by the trailer 40. In the case in which the marine vessel 11 is equipped with the automatic trailering function, the CPU 31 may judge that the hull 13 is being loaded onto the trailer 40 in response to an operation that enables the automatic trailering function to be performed (for example, turning-on of a button for the automatic trailering function). It should be noted that in the variety of methods described above, a threshold value for use in a judgment whether greater or less may vary depending on the method used.

When the CPU 31 judges in the step S101 that the hull 13 is being loaded onto the trailer 40, the process proceeds to step S103, and when the CPU 31 judges that the hull 13 is not being loaded onto the trailer 40, the process proceeds to step S102. In the step S103, the CPU 31, which includes a processor, controls the trim tab actuators 22A and 22B of the respective trim tab units 20A and 20B to position the respective tabs 21A and 21B at the retracted positions. This prevents the tabs 21A and 21B from coming into contact with the rail 41 of the trailer 40 or the like.

It should be noted that even in a case in which the tabs 21A and 21B have already been positioned at the retracted positions before they are actuated, the CPU 31 may control the trim tab actuators 22A and 22B to actuate the tabs 21A and 21B to the retracted positions. It should be noted that the marine vessel 11 may be provided with sensors that detect the swing positions of the tabs 21A and 21B. In the case in which the marine vessel 11 is equipped with such sensors, the CPU 31 may control the trim tab actuators 22A and 22B to actuate the tabs 21A and 21B toward the retracted positions only when the detected swing positions of the tabs 21A and 21B do not agree with the retracted positions.

Then, in step S104, the CPU 31 carries out "other processes". As the other processes, processes are carried out according to, for example, settings made and operations performed with the setting operation unit 19. Also, in response to the maneuvering system being stopped, a process that ends this flowchart is carried out. It should be noted that modes set using the setting operation unit 19 may include an "automatic posture control mode". This automatic posture control mode is a mode in which an automatic posture control function which is a control function of the controller 30 and in which the tabs 21A and 21B are moved so as to control the posture of the hull 13 during sailing is enabled. With the automatic posture control function, the tabs 21A and 21B are lowered to cause the hull 13 to produce a lift force so that the posture of the hull 13 can be changed or stabilized as disclosed in, for example, Japanese Laid-Open Patent Publication (Kokai) No. 2009-262588. It should be noted that when the CPU 31 judges that the hull 13 is being loaded onto the trailer 40, the process to control the trim tab actuators 22A and 22B to position the respective tabs 21A and 21B at the retracted positions is carried out in the step S103 irrespective of whether or not the automatic posture control function is being executed. After the step S104, the process returns to the step S101.

In the step S102, the CPU 31, which defines and functions as a detection unit, judges whether or not the hull 13 has entered a speed restriction zone. For example, map information (or nautical chart information) is stored in the ROM 32 in advance. The map information includes information on the speed restriction zone. The CPU 31 obtains a present position of the hull 13 from a GPS signal received by the receiver 39. Referring to the map information, the CPU 31 judges whether or not the hull 13 has entered the speed restriction zone based on the present position. Alternatively, the CPU 31 judges that the hull 13 has entered the speed restriction zone when the receiver 39 has received an identification signal received from the speed restriction zone or land in the vicinity of the speed restriction zone.

When the CPU 31 judges in the step S102 that the hull 13 has entered the speed restriction zone, the process proceeds to the step S103. When the CPU 31 does not judge that the hull 13 has entered the speed restriction zone, the process proceeds to the step S104. As a result of proceeding from the step S102 to the step S103, the tabs 21A and 21B are positioned at the retracted positions in the speed restriction zone. This is because the speed restriction zone is assumed to be shallow water, and thus from the viewpoint of avoiding contact with a foreign object such as the sea bottom, the tabs 21A and 21B are preferably raised to the retracted positions, and in addition, there is a possibility that the hull 13 will be loaded onto the trailer 40. Moreover, another reason is that usually the hull 13 does not sail at high speed in the speed restriction zone, and thus the necessity to control the posture of the hull 13 by lowering the tabs 21A and 21B is small.

According to the present preferred embodiment, upon judging that the hull 13 is being loaded onto the trailer 40, the CPU 31 controls the trim tab actuators 22A and 22B to position the tabs 21A and 21B, which are posture control tabs, at the retracted positions. This prevents the tabs 21A and 21B from coming into contact with a foreign object such as the trailer 40.

Moreover, upon detecting that the hull 13 has entered the speed restriction zone, the CPU 31 controls the trim tab actuators 21A and 21B to position the tabs 21A and 21B at the retracted positions even if the hull 13 is not being loaded onto the trailer 40. This prevents the tabs 21A and 21B from coming into contact with a foreign object such as the sea bottom, the ground, or the trailer 40. It should be noted that it is not necessary to include both of the steps S101 and S102 in the flowchart in FIG. 5. If the step S101 is omitted, the CPU 31 controls the trim tab actuators 21A and 21B to position the tabs 21A and 21B at the retracted positions when it has detected that the hull 13 has entered the speed restriction zone irrespective of whether the hull 13 is being loaded onto the trailer 40.

It should be noted that as the posture control tabs, interceptor tabs may be used in place of the tabs 21A and 21B. Each of the interceptor tabs changes its position from a position at which it projects from a bottom surface (the vessel bottom) of the hull 13 to a position which is above the bottom surface of the hull 13.

It should be noted that the setting operation unit 19 may be configured to make a setting as to whether or not to carry out the trim tab retracting process, which was described with reference to FIG. 5, when the maneuvering system is activated.

It should be noted that the number of outboard motors mounted on the hull 13 may be one or three or more. Also, the hull 13 may be equipped with three or more trim tab units. Marine vessels to which preferred embodiments of the present invention are applicable are not limited to those equipped with outboard motors, but the present invention is also applicable to marine vessels equipped with other types of marine propulsion devices such as inboard/outboard motors (stern drive, inboard motor/outboard drive), inboard motors, and water jet drive.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A control system comprising:

posture control tabs mounted on a stern of a marine vessel to control a posture of a hull of the marine vessel;

actuators to actuate the posture control tabs; and a central processing unit configured or programmed to define and function as:

a judgment unit to judge whether or not the hull is being loaded onto a trailer; and a processor to, upon the judgment unit judging that the hull is being loaded onto the trailer, control the actuators to position the posture control tabs at retracted positions; wherein the judgment unit judges that the hull is being loaded onto the trailer when conditions that a speed of the hull is less than a predetermined speed, and a predetermined pitch angle is less than a pitch angle of the hull are satisfied;

the judgment unit judges that the hull is being loaded onto the trailer when conditions that the speed of the hull is less than the predetermined speed, and a predetermined engine rpm is less than a number of engine revolutions of a propulsion device including an engine are satisfied;

the judgment unit judges that the hull is being loaded onto the trailer when the speed of the hull has not exceeded the predetermined speed for a predetermined period of time since a throttle opening angle of the propulsion device became greater than a predetermined opening angle;

the judgment unit judges that the hull is being loaded onto the trailer when conditions that an acceleration of the hull is less than a predetermined acceleration, and the predetermined pitch angle is less than a pitch angle of the hull are satisfied;

the judgment unit judges that the hull is being loaded onto the trailer when conditions that the acceleration of the hull is less than the predetermined acceleration, and the predetermined engine rpm is less than the number of engine revolutions of the propulsion device are satisfied;

the judgment unit judges that the hull is being loaded onto the trailer when the acceleration of the hull has never exceeded the predetermined acceleration for a predetermined period of time since the throttle opening angle of the propulsion device became greater than the predetermined opening angle;

the judgment unit judges that the hull is being loaded onto the trailer when the predetermined pitch angle is less than the pitch angle of the hull, even if a state in which the predetermined opening angle is less than the throttle opening angle of the propulsion device has continued for a predetermined period of time; or the judgment unit judges that the hull is being loaded onto the trailer when the predetermined pitch angle is less than the pitch angle of the hull, even if a state in which the predetermined engine rpm is less than the number of engine revolutions of the propulsion device has continued for a predetermined period of time.

2. The control system according to claim 1, wherein the processor performs an automatic posture control function to move the posture control tabs so as to control a posture of the hull during sailing; and upon the judgment unit judging that the hull is being loaded onto the trailer, the processor controls the actuators to position the posture control tabs at the retracted positions irrespective of whether or not the automatic posture control function is being executed.

3. The control system according to claim 1, wherein the central processing unit is configured or programmed to define and function as a detection unit to detect whether or not the hull has entered a speed restriction zone; and upon the detection unit detecting that the hull has entered the speed restriction zone, the processor controls the actuators to position the posture control tabs at the retracted positions even in a case in which the judgment unit judges that the hull is not being loaded onto the trailer.

4. The control system according to claim 3, wherein the detection unit obtains positional information, and detects whether or not the hull has entered the speed restriction zone based on the obtained positional information and map information.

5. The control system according to claim 3, further comprising:

a receiver to receive an identification signal transmitted in the speed restriction zone; wherein upon the receiver receiving the identification signal, the detection unit detects that the hull has entered the speed restriction zone.

6. A marine vessel comprising:

a hull; and a control system including:

posture control tabs mounted on a stern to control a posture of the hull;

actuators to actuate the posture control tabs; and a central processing unit configured or programmed to define and function as:

a judgment unit to judge whether or not the hull is being loaded onto a trailer; and a processor to, upon the judgment unit judging that the hull is being loaded onto the trailer, control the actuators to position the posture control tabs at retracted positions; wherein the judgment unit judges that the hull is being loaded onto the trailer when conditions that a speed of the hull is less than a predetermined speed, and a predetermined pitch angle is less than a pitch angle of the hull are satisfied;

the judgment unit judges that the hull is being loaded onto the trailer when conditions that the speed of the hull is less than the predetermined speed, and a predetermined engine rpm is less than a number of engine revolutions of a propulsion device including an engine are satisfied;

the judgment unit judges that the hull is being loaded onto the trailer when the speed of the hull has not exceeded the predetermined speed for a predetermined period of time since a throttle opening angle of the propulsion device became greater than a predetermined opening angle;

the judgment unit judges that the hull is being loaded onto the trailer when conditions that an acceleration of the hull is less than a predetermined acceleration, and the predetermined pitch angle is less than a pitch angle of the hull are satisfied;

the judgment unit judges that the hull is being loaded onto the trailer when conditions that the acceleration of the hull is less than the predetermined acceleration, and the predetermined engine rpm is less than the number of engine revolutions of the propulsion device are satisfied;

the judgment unit judges that the hull is being loaded onto the trailer when the acceleration of the hull has never exceeded the predetermined acceleration for a predetermined period of time since the throttle opening angle of the propulsion device became greater than the predetermined opening angle;

the judgment unit judges that the hull is being loaded onto the trailer when the predetermined pitch angle is less than the pitch angle of the hull, even if a state in which the predetermined opening angle is less than the throttle opening angle of the propulsion device has continued for a predetermined period of time; or the judgment unit judges that the hull is being loaded onto the trailer when the predetermined pitch angle is less than the pitch angle of the hull, even if a state in which the predetermined engine rpm is less than the number of engine revolutions of the propulsion device has continued for a predetermined period of time.

7. A method for controlling posture control tabs of a marine vessel including posture control tabs mounted on a stern to control a posture of a hull, and actuators to actuate the posture control tabs, the method comprising:

judging with a judgment unit whether or not the hull is being loaded onto a trailer; and upon the judgment unit judging that the hull is being loaded onto the trailer, controlling with a processor the actuators to position the posture control tabs at retracted positions; wherein the judgment unit judges that the hull is being loaded onto the trailer when conditions that a speed of the hull is less than a predetermined speed, and a predetermined pitch angle is less than a pitch angle of the hull are satisfied;

the judgment unit judges that the hull is being loaded onto the trailer when conditions that the speed of the hull is less than the predetermined speed, and a predetermined engine rpm is less than a number of engine revolutions of a propulsion device including an engine are satisfied;

the judgment unit judges that the hull is being loaded onto the trailer when the speed of the hull has not exceeded the predetermined speed for a predetermined period of time since a throttle opening angle of the propulsion device became greater than a predetermined opening angle;

the judgment unit judges that the hull is being loaded onto the trailer when conditions that an acceleration of the hull is less than a predetermined acceleration, and the predetermined pitch angle is less than a pitch angle of the hull are satisfied;

the judgment unit judges that the hull is being loaded onto the trailer when conditions that the acceleration of the hull is less than the predetermined acceleration, and the predetermined engine rpm is less than the number of engine revolutions of the propulsion device are satisfied;

the judgment unit judges that the hull is being loaded onto the trailer when the acceleration of the hull has never exceeded the predetermined acceleration for a predetermined period of time since the throttle opening angle of the propulsion device became greater than the predetermined opening angle;

the judgment unit judges that the hull is being loaded onto the trailer when the predetermined pitch angle is less than the pitch angle of the hull, even if a state in which the predetermined opening angle is less than the throttle opening angle of the propulsion device has continued for a predetermined period of time; or the judgment unit judges that the hull is being loaded onto the trailer when the predetermined pitch angle is less than the pitch angle of the hull, even if a state in which the predetermined engine rpm is less than the number of engine revolutions of the propulsion device has continued for a predetermined period of time.

* * * * *